US010658133B2

(12) United States Patent
Fruchard et al.

(10) Patent No.: US 10,658,133 B2
(45) Date of Patent: May 19, 2020

(54) CONTROL DEVICE OF PUSH-BUTTON TYPE WITH FLAT ARCHITECTURE

(71) Applicant: Schneider Electric Industries SAS, Rueil-Malmaison (FR)

(72) Inventors: Bertrand Fruchard, L'Isle d'Espagnac (FR); Francis Chauvet, Mouthiers (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 16/178,828

(22) Filed: Nov. 2, 2018

(65) Prior Publication Data

US 2019/0164701 A1 May 30, 2019

(30) Foreign Application Priority Data

Nov. 27, 2017 (FR) ..... 17 61204

(51) Int. Cl.

| | |
|---|---|
| ***H01H 13/62*** | (2006.01) |
| ***H01H 3/12*** | (2006.01) |
| ***H01H 13/52*** | (2006.01) |
| ***H01H 3/50*** | (2006.01) |
| ***H01H 13/02*** | (2006.01) |

(52) U.S. Cl.

CPC ..... *H01H 13/62* (2013.01); *H01H 3/122* (2013.01); *H01H 3/50* (2013.01); *H01H 13/023* (2013.01); *H01H 13/52* (2013.01); *H01H 2003/506* (2013.01); *H01H 2219/037* (2013.01); *H01H 2221/04* (2013.01)

(58) Field of Classification Search

CPC ..... H01H 13/62; H01H 3/50; H01H 13/023; H01H 13/52; H01H 3/122; H01H 2221/04; H01H 2003/506; H01H 2219/037

USPC ..... 200/344

See application file for complete search history.

(56) References Cited

U.S. PATENT DOCUMENTS 6,858,812 B2 * 2/2005 Sasaki ..... H01H 25/041 200/341
2013/0021770 A1 1/2013 Yang
2014/0190810 A1 7/2014 Krumpelman et al.

(Continued)

OTHER PUBLICATIONS

European Search Report dated Apr. 17, 2019 in Patent Application No. 18204605.2 (with English translation of categories of cited documents), 8 pages.

(Continued)

*Primary Examiner* — Edwin A. Leon
*Assistant Examiner* — Lheiren Mae A Caroc
(74) *Attorney, Agent, or Firm* — Oblon, McClelland, Maier & Neustadt, L.L.P.

(57) ABSTRACT

A push-button with a receptacle and a cover plate, an actuating button actuatable in translation between two positions, a rest position and a pushed-in position, the cover plate being arranged at the periphery of the actuating button, a device for guiding the actuating button in translation between the two positions, and a return device for returning the actuating button from the pushed-in position toward the rest position. The guiding device include at least a pin including a bent rod shaped to have a first part pivotally mounted on a fastening unit of the actuating button and a second part pivotally mounted on a fastening unit of the cover plate, and the return device are designed to act on the pin by mechanical or magnetic effect.

13 Claims, 3 Drawing Sheets

(56) References Cited

U.S. PATENT DOCUMENTS

| | | | | |
|---|---|---|---|---|
| 2014/0190811 | A1 | 7/2014 | Bolender et al. | |
| 2014/0231234 | A1 | 8/2014 | Hsu et al. | |
| 2016/0118203 | A1* | 4/2016 | Moua ..... | H01H 13/705<br>307/115 |
| 2016/0308531 | A1 | 10/2016 | Bolender et al. | |

OTHER PUBLICATIONS

French Preliminary Search Report dated Aug. 6, 2018 in French Application 17 61204 filed on Nov. 27, 2017(with English Translation of Categories of Cited Documents and Written Opinion).

* cited by examiner

CONTROL DEVICE OF PUSH-BUTTON TYPE WITH FLAT ARCHITECTURE

TECHNICAL FIELD OF THE INVENTION

The present invention relates to a control device of push-button type having a flat architecture and comprising enough space at the back to house an electronic circuit, contacts, a light unit, etc., thereat.

PRIOR ART

Conventionally, a device of push-button type as described in the patent EP2754162B1 comprises a body, an actuating button or a key mobile between two positions, a rest position and a pushed-in position, and return means for returning the actuating button from the pushed-in position toward the rest position thereof. The return means comprise a spring positioned in the body of the device and being housed between the bottom of the body and the button. This device has a particularly flat architecture. Therefore, it only has a small amount of space available in order to house, at the back of the button, a light element and/or an electronic circuit, for example dedicated to communications or any other device.

Devices of keyboard key type, for example for a computer, are also known. The U.S. Pat. No. 6,080,948 describes such a solution in which the key is fixed to a base plate by means of a frame-shaped piece for the guiding thereof. In the centre of the base plate and standing between the two pivoting parts of the frame, the device includes a rubber piece for returning the key toward the rest position thereof. In this solution, the central space is also occupied by the rubber piece used to return the key, not making it possible to position, at this point, a light unit and/or an electronic circuit, for example dedicated to communications or any other device.

Another device of button type is also known from the document US2014190810. In this document, the proposed architecture is particularly compact. However, it is not optimal, particularly with regard to the solution for return of the button.

Therefore, there is a requirement to propose a device of push-button type that can have a particularly flat architecture while being provided with enough space at the back of the actuating button thereof to receive any device, such as one or more electrical contacts, a light unit and/or an electronic circuit dedicated to communications with a master control module. Moreover, the proposed architecture must be optimal in terms of spatial requirement and compactness, while still operating reliably.

DISCLOSURE OF THE INVENTION

This requirement is met by the device of push-button type as defined below.

The device of push-button type includes:

- a body comprising a casing comprising a receptacle and a cover plate (11) fixed on the receptacle,
- an actuating button that can be actuated in translation along a main axis X with respect to the body between at least two positions, a rest position and a pushed-in position, the cover plate being arranged at the periphery of the actuating button,
- guiding means for guiding the actuating button in translation between the two positions thereof,
- return means for returning the actuating button from the pushed-in position toward the rest position, According to a feature, the guiding means comprise at least a pin comprising a bent rod shaped to have a first part pivotally mounted on a fastening unit of the actuating button and at least a second part pivotally mounted on a fastening unit of the cover plate.

According to another feature, the return means are rigidly connected to the body and designed to act on the pin by mechanical or magnetic effect.

According to another feature, the actuating button includes an external face, located on the outside of the casing and an internal face, located on the inside of the casing, the cover plate includes an external face, located on the outside of the casing and an internal face, located on the inside of the casing, the fastening unit of the actuating button is fixed on the internal face of said actuating button, and the fastening unit of the cover plate is fixed on the internal face of the cover plate.

According to another feature, the return means include at least one permanent magnet fixed on the cover plate and designed to cooperate by magnetic effect with at least a free end of the pin, said free end being designed to be in contact with a bearing plane of the permanent magnet when the actuating button is in the rest position.

According to another feature, the free end of the pin is designed to pivot between two positions when the actuating button moves between the rest position thereof and the pushed-in position thereof and is arranged opposite the permanent magnet.

According to another feature, the free end of the pin includes a bevel or a flattening arranged to be in contact with the bearing plane of the permanent magnet when the actuating button is in the rest position.

According to an alternative embodiment, the return means include at least a spring fixed firstly to the pin and secondly to the cover plate.

According to another feature, the actuating button has a rectangular or square general shape.

According to another feature, the cover plate includes an opening of rectangular or square shape and in that the actuating button is designed such that the outer edge thereof matches the inner edge of the opening.

According to another feature, the device includes a first pin arranged along a first side of the actuating button and an opening first edge located opposite, and a second pin arranged along a second edge of the actuating button and an opening second edge located opposite.

According to another feature, the device includes an electronic board fixed to the bottom of the casing.

According to another feature, the actuating button includes at least one transparent part and the electronic board includes a light-emitting diode set up to emit a light signal through said transparent part.

BRIEF DESCRIPTION OF THE FIGURES

Other features and advantages will emerge in the following detailed description with reference to the appended drawings wherein.

DETAILED DESCRIPTION OF AT LEAST ONE EMBODIMENT

Figure 1:
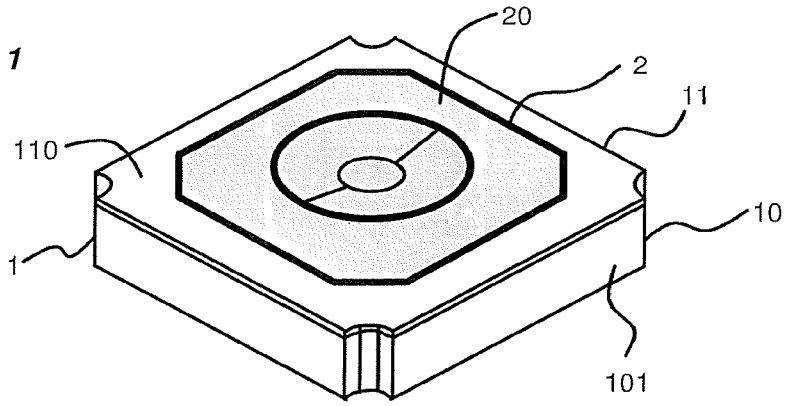
FIG. 1 shows, in perspective, the device of push-button type according to the invention.
Figure 2A:
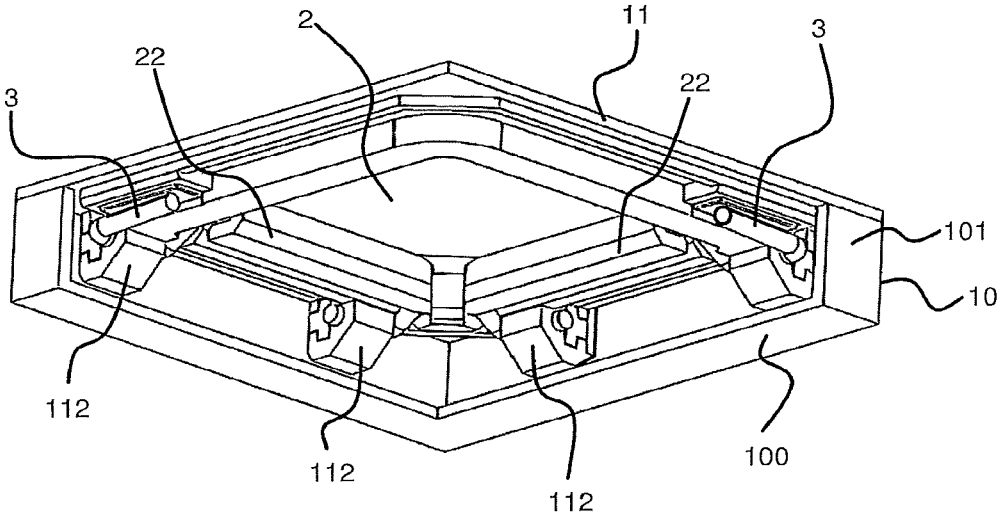
FIGS. 2A and 2B show, in perspective, the underside of the actuating part of the device of push-button type of the invention, in the rest state and in the pushed-in state, respectively.
Figure 2B:
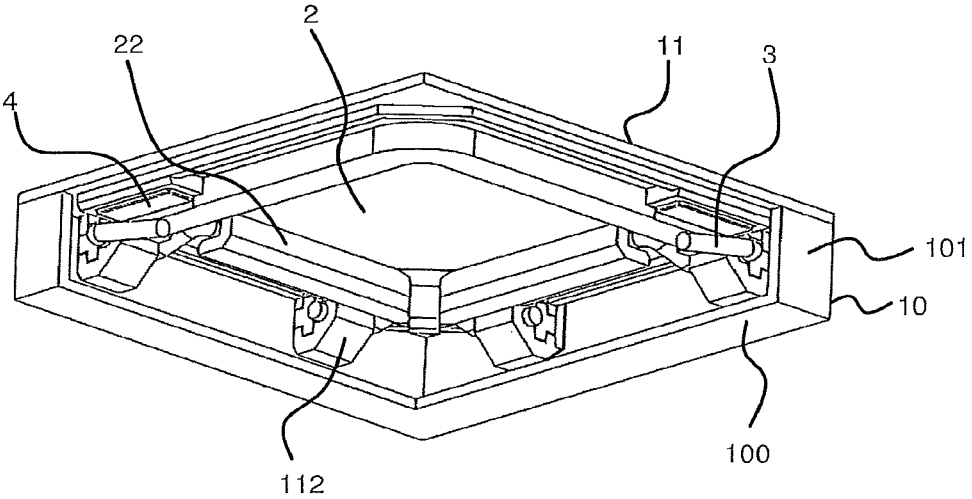
Figure 3A:
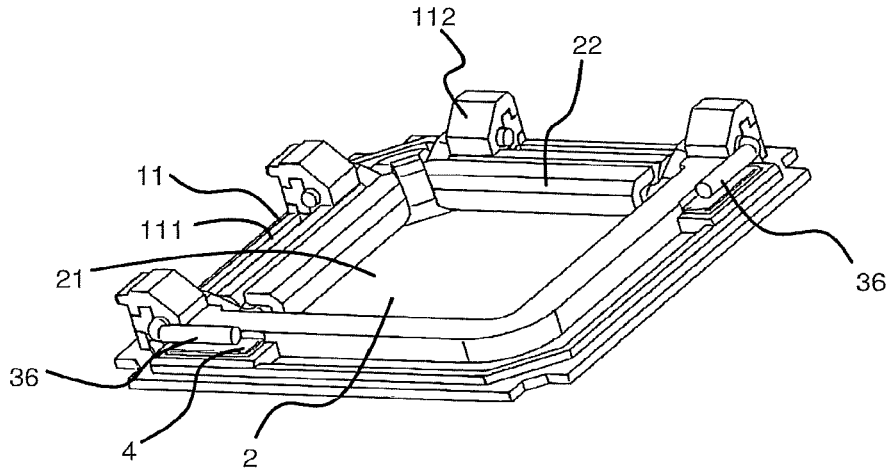
FIGS. 3A and 3B show, in perspective and from below, the device of push-button type of the invention, in the rest state and in the pushed-in state, respectively.
Figure 3B:
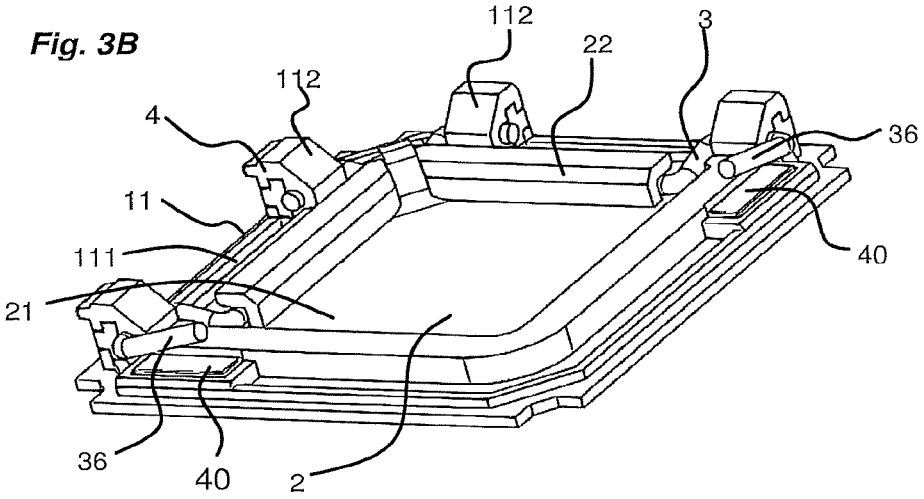
Figure 4A:
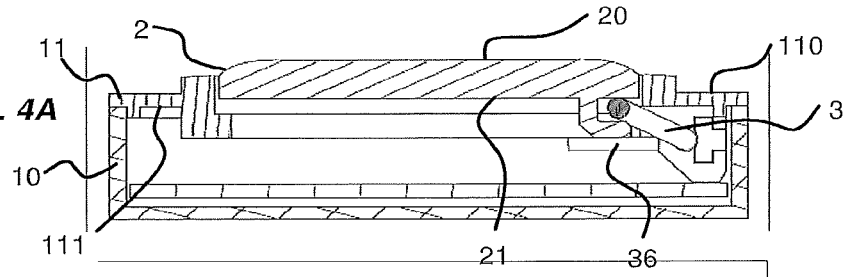
FIGS. 4A and 4B show, according to a section, the device of push-button type of the invention, in the rest state and in the pushed-in state, respectively.
Figure 4B:
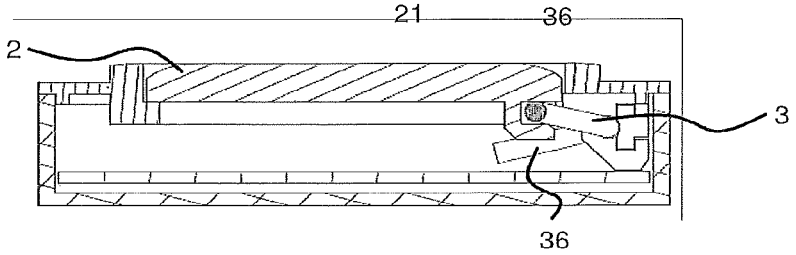

In the remainder of the description, the terms "top", "base", "upper", "lower" are to be considered by taking into account an axis (X) drawn vertically in the plane of the sheet.

The invention relates to a device of push-button type.

The device of push-button type includes a body 1.

The body 1 includes at least two parts forming a casing, a base part forming a receptacle 10 and comprising a housing and a top part forming a cover plate 11 and intended to fit onto the base part via any suitable means. The cover plate 11 is arranged in a removable manner with respect to the receptacle 10, allowing it to be easily taken off.

The base part can have a flat bottom 100 and lateral sides 101 standing perpendicular with respect to said bottom.

The device includes a mobile actuating button 2, which can also be referred to as a cap or key.

This actuating button 2 can be translated between two positions, a rest position in which it is not actuated, and a pushed-in position in which it has been actuated and has undertaken the translation movement thereof.

In a nonlimiting manner, the actuating button 2 can have a square or rectangular general shape defined by the outer edge thereof.

The actuating button 2 includes a first face, called an external face 20, located on the outside of the casing and forming the bearing face on which a pression can be exerted to press upon the button and a second face, called an internal face 21, in the opposite direction to said external face and located on the inside of the casing.

The cover plate 11 also includes a first face, called an external face 110, located on the outside of the casing and able to be flush with the outer face of the button and located at the periphery of said button when the button is in the rest position and a second face, called an internal face 111, in the opposite direction to said external face and located on the inside of the casing.

The cover plate 11 includes an opening having a shape complementary to that of the actuating button such that the latter can move in said opening when it is actuated from one position to the other. The cover plate 11 is thus arranged at the periphery of the outer edge of the actuating button 2.

According to an aspect of the invention, the device includes guiding means arranged to guide the actuating button 2 when it is moved between the two positions thereof, from the rest position toward the pushed-in position and from the pushed-in position toward the rest position.

According to an aspect of the invention, the device includes return means arranged to return the actuating button from the pushed-in position thereof toward the rest position thereof.

The guiding means include one or more guiding units.

In a nonlimiting manner and with reference to the appended figures, the guiding means include two guiding units.

Each guiding unit includes a pin 3.

The two pins are arranged along two separate sides formed by the outer edge of the actuating button 2.

In order to fix each pin 3, the actuating button 2 can include at least one fastening unit 22 disposed on the internal face 21 thereof and the cover plate 11 can include at least one fastening unit 112 disposed on the internal face 111 thereof. Advantageously, for each pin, the actuating button 2 includes a single fastening unit 22 on the internal face 21 thereof and the cover plate 11 includes two fastening units 112 on the internal face 111 thereof.

Figure 7:
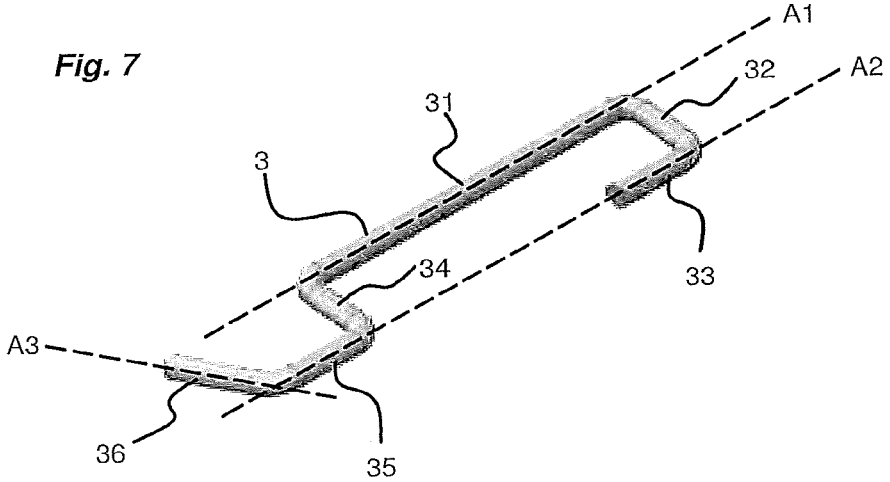
FIG. 7 shows, in perspective, a pin as used in the device of push-button type of the invention.

With reference to FIG. 7, the pin 3 can have the shape of a constant circular section bent rod comprising several separate portions. Preferably, the pin 3 is produced from a metal material.

The pin 3 can include a straight first central portion 31 fixed to said actuating button 2 by the fastening unit 22 thereof. The central portion 31 includes a first end and a second end.

The central portion 31 of the pin 3 is extended, at the first end thereof, by a straight second portion 32 forming a first right-angle bend with said central portion 31.

The second portion 32 of the pin is extended by a straight third portion 33 forming a second right-angle bend with the second portion 32. The third portion 33 is thus parallel to the central portion 31. The second bend is produced such that the third portion 33 is oriented by forming a U with the central portion 31. The third portion is shorter than the central portion.

The central portion 31 is extended, at the second end thereof, by a straight forth portion 34 forming a third right-angle bend with said central portion 31.

The fourth portion 34 is parallel to said second portion 32 and has the same length as the latter. The fourth portion 34 is oriented in the same direction as that of the second portion 32.

The fourth portion 34 is extended by a straight fifth portion 35 forming a fourth right-angle bend with said fourth portion 34.

The fifth portion 35 is located in the same axis as the third portion 33 and is thus parallel to the central portion 31.

The fourth bend is produced such that the fifth portion 35 is oriented in the same direction as that of the third portion 33.

The axes of the central portion 31, of the second portion 32, of the third portion 33, of the fourth portion 34 and of the fifth portion 35 (axes defined along the straight direction thereof) are located in a same plane.

The fifth portion 35 is extended by a straight sixth portion 36, forming a fifth right-angle bend with respect to the fifth portion 35.

The sixth portion 36 is parallel to the second portion 32 and to the fourth portion 34, but the axis thereof is oriented along a plane that is inclined with respect to said plane defined above and in an opposite direction to that of the second portion 32 and of the fourth portion 34. The axis A3 of the sixth portion of the pin is therefore not included in said plane.

So, the pin 3 is fastened by a first part to the fastening unit 22 of the actuating button. This first part corresponds to the central portion 31 of the pin 3. The pin 3 is also fastened by a second part to the cover plate 11. This second part corresponds to the third portion 33 and the fifth portion 35 of the pin 3, which are each fastened to a fastening unit 112 of the cover plate 11.

Each pin 3 includes a first pivoting axis A1 defined by the linking of the central portion 31 thereof to the fastening unit 22 of the actuating button 2 and a second pivoting axis A2 defined by the linking of the third portion 33 thereof and of the fifth portion 35 thereof to the respective fastening unit 112 thereof on the cover plate 11.

When the actuating button 2 is pushed-in, moving from the rest position thereof to the pushed-in position thereof, each pin 3 pivots around the pivoting axis A1, A2 thereof, allowing the actuating button 2 to be guided in the translation movement thereof.

The device includes return means for the actuating button, which are arranged to bring the actuating button 2 back from the pushed-in position thereof toward the rest position thereof.

According to a specific aspect of the invention, these return means are designed to act directly upon each pin 3 and not on the actuating button 2, which allows to optimize the available space under the actuating button 2, especially to be able to put a light unit.

In a first embodiment, the action on each pin can be magnetic and, in a second embodiment, the action can be solely mechanical. The return means act directly upon a free end 36 of the pin 3, corresponding to the sixth portion 36 of the pin.

In the first embodiment, the return means can include, for each pin 3, a separate permanent magnet 4 fixed to the cover plate 11, opposite the free end 36 of the pin 3. This can be the same permanent magnet set up and arranged to have two separate portions opposite each pin.

Each permanent magnet 4 defines a bearing plane 40 on the internal face 111 of the cover plate 11.

These magnetic return means make it possible to exert a magnetic effect on the pin 3 in order to simultaneously bring the actuating button 2 back from the pushed-in position thereof toward the rest position thereof but also to provide a tactile effect when the actuating button 2 is pressed. In the latter case, the magnetic force produced by each permanent magnet 4 keeps the actuating button 2 in the rest position thereof so long as a sufficient mechanical force is not exerted on the actuating button 2 in order to break away from the magnetic attraction exerted by each permanent magnet.

Figure 5A:
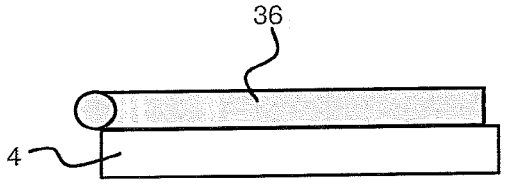
FIGS. 5A and 5B illustrate the operating principle of the return means used in the device of the invention.
Figure 5B:
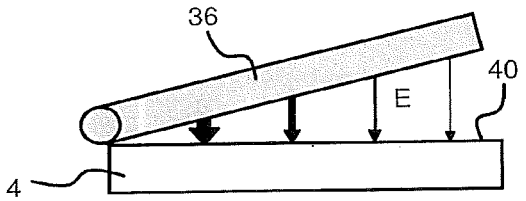

With reference to FIG. 7, the sixth portion 36 of the pin has a degree of inclination defined by the axis A3 thereof such as to be in contact with the bearing plane 40 of a permanent magnet 4 when the actuating button 2 is in the rest position and inclined with respect to said bearing plane 40 when the actuating button 2 is in the pushed-in position, while maintaining at least a point or a surface of contact with said permanent magnet 4. With reference to FIGS. 5A, and 5B, the air gap E varies angularly, i.e. there is always a point or a surface of contact between the permanent magnet and the pin. This arrangement makes it possible to have a return effort which does not decrease too quickly and which is always sufficient to return the actuating button toward the rest position thereof.

Figure 6:
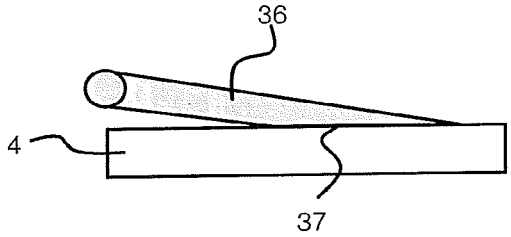
FIG. 6 shows an alternative embodiment of the principle illustrated in FIGS. 5A and 5B.

With reference to FIG. 6, the sixth portion 36 of the pin can also have a bevel 37 at the end thereof or a flattening, which makes it possible to maximize the contact surface between the pin 3 and the bearing plane 40 of the permanent magnet 4 when the actuating button 2 is in the rest position and to maximize the air gap between the surface formed by the bevel or the flattening and the bearing plane of the permanent magnet 4 when the actuating button 2 is pressed toward the pushed-in position thereof.

In the second embodiment, the return means can include at least one spring fixed firstly to the pin 3 (or to each pin 3 if several pins are used) and secondly to the cover plate 11. The spring can be arranged to stretch out during a pressure on the actuating button 2 from the rest position thereof toward the pushed-in position thereof and to come back to the original shape thereof when the pressure on the button 2 is released. One or more permanent magnets can be retained in order to provide the tactile effect when the actuating button 2 is pushed in.

The architecture of the device of the invention thus makes it possible to free up space in the casing thereof, particularly at the centre, since the guiding means, as well as the return means have been shifted to the outside.

Figure 8:
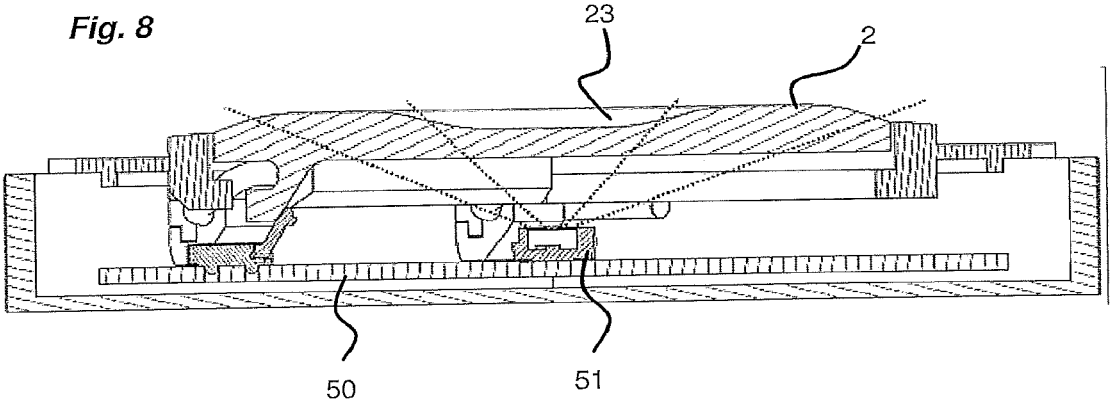
FIG. 8 shows, according to a section, an alternative embodiment of the device of push-button type of the invention.

The free space formed in this manner can, for example, be occupied by an electronic board 50. By way of example, with reference to FIG. 8, this electronic board can include at least one light unit 51 such as a light-emitting diode, a module for wired or wireless communications with an external master module and/or one or more electrical contacts. When a light unit 51 is present, the actuating button 2 can include at least one transparent part 23 in order to transmit the light flux outward.

The device can include one or more detection units for detecting the presence of the actuating button 2 in one position or in the two positions thereof. In other words, this is a matter of recognizing the position of the actuating button. A detection unit can be formed from a conventional electrical contact, a Hall effect sensor, a magnetic sensor or any other suitable solution. The detection unit can be arranged between the cover plate and the pin.

The device can include abutment units arranged firstly on the internal face of the cover plate and secondly on the internal face of the actuating button in order to restrict the translation of the actuating button 2 to the rest position thereof when it is returned from the pushed-in position thereof toward the rest position thereof.

With reference to FIGS. 2A and 2B, 3A and 3B and 4A and 4B, the device operates as follows:

Rest Position (FIGS. 2A, 3A and 4A):

the actuating button is in the rest position;

the sixth portion 36 of each pin 3 is bearing against the respective permanent magnet 4 thereof making it possible, via magnetic effect, to hold the actuating button 2 in this rest position;

the pivoting axis A1 is located in a plane higher than the pivoting axis A2 of each pin.

Actuation of the Button the actuating button is pressed toward the pushed-in position thereof;

the translation of the actuating button 2 is obtained when a sufficient mechanical force (in translation) is applied to the actuating button in order to break each pin away from the magnetic attraction exerted by the permanent magnet 4 thereof;

a tactile effect is created at the start of the translation of the button from the rest position toward the pushed-in position thereof;

the actuation of the actuating button 2 causes each pin to pivot around the two axes A1, A2 thereof;

during the translation of the actuating button 2, the pivoting axis A1 moves closer to the pivoting axis A2;

the sixth portion 36 of each pin pivots in order to, move away from the permanent magnet 4 thereof.

Pushed-In Position (FIGS. 2B, 3B and 4B):

the actuating button 2 reaches the pushed-in position thereof;

the sixth portion 36 of each pin is fully pivoted but remains inclined with respect to the bearing plane 40 formed by the permanent magnet, making it possible to maintain a magnetic effect between the pin 3 and the permanent magnet 4;

each pin 3 is fully pivoted around the two axes A1, A2 thereof;

if an electrical contact is present in the device, it can be actuated and the light unit, if present, can be illuminated.

Releasing the Button when the mechanical force exerted upon the actuating button 2 is stopped, the actuating button 2 rises back toward the rest position thereof;

the return of the actuating button 2 toward the rest position thereof is allowed thanks to the magnetic effect present between each pin 3 at the sixth portion 36 thereof and the permanent magnet 4 which faces the latter;

each pin 3 pivots around the two pivoting axes A1, A2 thereof.

The device of the invention thus has many advantages, including:

the entire mechanical part (guiding, tactile effect and return of the button) is linked to the back part of the cover plate 11. Space is freed up under the actuating button 2, in order to house electronics, for example, thereat;

a maximum free volume is left at the back of the product and this volume is not cut up by an element like the guiding pins or a return spring passing through it;

the tactile effect and the setting effort can be adjusted as a function of the surface of the pin 3 in contact with the permanent magnet 4.

The invention claimed is:

1. A device of push-button type comprising:

a body comprising a casing comprising a receptacle and a cover plate fixed on the receptacle;

an actuating button that is actuatable in translation along a main axis with respect to the body between at least two positions, a rest position and a pushed-in position, the cover plate being arranged at a periphery of the actuating button;

guiding means for guiding the actuating button in translation between the two positions thereof; and return means for returning the actuating button from the pushed-in position toward the rest position, wherein:

the guiding means comprise at least a pin comprising a bent rod shaped to have a first part pivotally mounted on a fastening unit of the actuating button, at least a second part pivotally mounted on a fastening unit of the cover plate, and a free end, an axis of the first part of the pin and an axis of the second part of the pin are oriented along a first plane, an axis of the free end of the pin is oriented along a second plane that is inclined with respect to the first plane, and the return means are rigidly connected to the body and designed to act on the pin by mechanical or magnetic effect.

2. The device according to claim 1, wherein:

the actuating button includes an external face, located on an outside of the casing and an internal face, located on an inside of the casing, the cover plate includes an external face, located on the outside of the casing and an internal face, located on the inside of the casing, the fastening unit of the actuating button is fixed on the internal face of said actuating button, and the fastening unit of the cover plate is fixed on the internal face of the cover plate.

3. The device according to claim 1, wherein the return means include at least one permanent magnet fixed on the cover plate and designed to cooperate by magnetic effect with at least the free end of the pin, said free end being designed to be in contact with a bearing plane of the permanent magnet when the actuating button is in the rest position.

4. The device according to claim 3, wherein the free end of the pin is designed to pivot between two positions when the actuating button moves between the rest position thereof and the pushed-in position thereof and is arranged opposite the permanent magnet.

5. The device according to claim 3, wherein the free end of the pin includes a bevel or a flattening arranged to be in contact with the bearing plane of the permanent magnet when the actuating button is in the rest position.

6. The device according to claim 1, wherein the actuating button has a rectangular or square general shape.

7. The device according to claim 6, wherein the cover plate includes an opening of rectangular or square shape and the actuating button is designed such that an outer edge thereof matches the inner edge of the opening.

8. The device according to claim 7, wherein the guiding means includes the first pin arranged along a first side of the actuating button, and a second pin arranged along a second edge of the actuating button.

9. The device according to claim 1, further comprising an electronic board fixed to a bottom of the casing.

10. The device according to claim 9, wherein the actuating button comprises at least one transparent part and wherein the electronic board includes a light-emitting diode set up to emit a light signal through said transparent part.

11. The device according to claim 1, wherein the free end extends from the second part and forms a right-angle bend with respect to the second part.

12. The device according to claim 1, wherein the first part and the second part are parallel to each.

13. A device of push-button type comprising:

a body comprising a casing comprising a receptacle and a cover plate fixed on the receptacle;

an actuating button that is actuatable in translation along a main axis with respect to the body between two positions, the cover plate being arranged at a periphery of the actuating button; and a guide to guide the actuating button in translation between the two positions thereof, the guide comprising a pin comprising a bent rod shaped to have a first part pivotally mounted on a fastener of the actuating button, a second part pivotally mounted on a fastener of the cover plate, and a free end, wherein an axis of the first part of the pin and an axis of the second part of the pin are oriented along a first plane, and an axis of the free end of the pin is oriented along a second plane that is inclined with respect to the first plane.

* * * * *